US006364215B1

(12) United States Patent
Andre et al.

(10) Patent No.: US 6,364,215 B1
(45) Date of Patent: Apr. 2, 2002

(54) GUIDE RAIL WITH ENGAGING-RELEASING SLOTS FOR A ROLLER GUIDE ASSEMBLY IN PARTICULAR WITH INCLINED ROLLERS

(75) Inventors: Jean-Luc Andre, Obernai; Martin Koerber, Molsheim, both of (FR)

(73) Assignee: Lohr Industries, Hangenbisten (FR)

( * ) Notice: Subject to any disclaimer, the term of this patent is extended or adjusted under 35 U.S.C. 154(b) by 0 days.

(21) Appl. No.: 09/744,147

(22) PCT Filed: Jul. 28, 1999

(86) PCT No.: PCT/FR99/01850

§ 371 Date: Jan. 18, 2001

§ 102(e) Date: Jan. 18, 2001

(87) PCT Pub. No.: WO00/06826

PCT Pub. Date: Feb. 10, 2000

(30) Foreign Application Priority Data

Jul. 29, 1998 (FR) ..... 98 09813

(51) Int. Cl.[7] ..... E01B 5/00

(52) U.S. Cl. ..... 238/122; 238/125

(58) Field of Search ..... 104/244, 261, 104/264, 265; 238/122, 123, 125, 130, 129, 136, 139, 140, 142, 143, 148, 149

(56) References Cited

U.S. PATENT DOCUMENTS 774,401 A * 11/1904 Sutliff ..... 238/143
1,061,037 A * 5/1913 Beasecker ..... 238/143
6,029,579 A * 2/2000 Andre et al. ..... 104/244

FOREIGN PATENT DOCUMENTS

JP 7-61345 3/1995

* cited by examiner

*Primary Examiner*—Mark T. Le
(74) *Attorney, Agent, or Firm*—Davis & Bujold, P.L.L.C.

(57) ABSTRACT

A guide rail for guiding a pair of angled or horizontal guide wheels (17,18) of a guide assembly. The guide rail comprises a rail base (2), a rail head (4), and a rail web (3) interconnecting the rail base (2) with the rail head (4). The rail head (4) has at least one zone facilitating engagement and disengagement of the guide wheels with the guide rail. The zone has a narrowed area in which the guide head (4) has a narrower transverse width dimension which is less than the larger transverse width dimension on opposite sides of the zone and less than a normal engagement spacing of the guide wheels from one another such that the pair of guide wheels (17,18) are only movable vertically into and out of engagement with the guide in the zone while the pair of guide wheels (17,18) are prevented from moving vertically into and out of engagement with the guide rail, relative to the guide rail, by the larger transverse width dimension of the guide head (4).

22 Claims, 5 Drawing Sheets

FIG.4
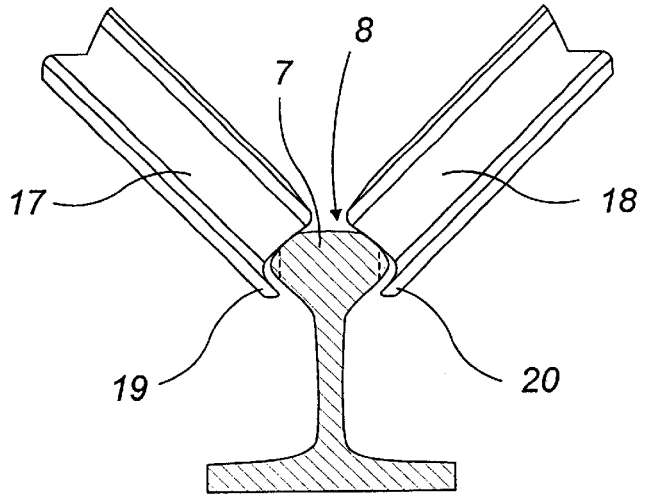
FIG.5
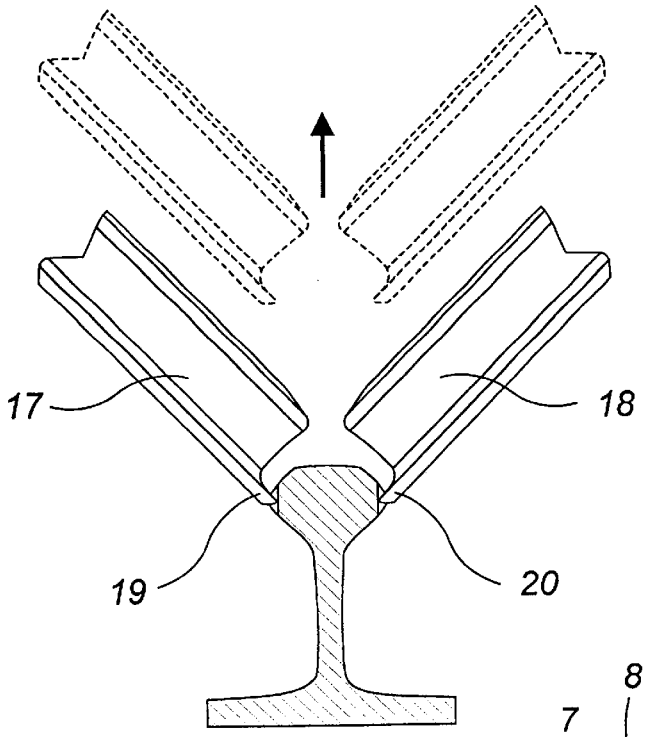
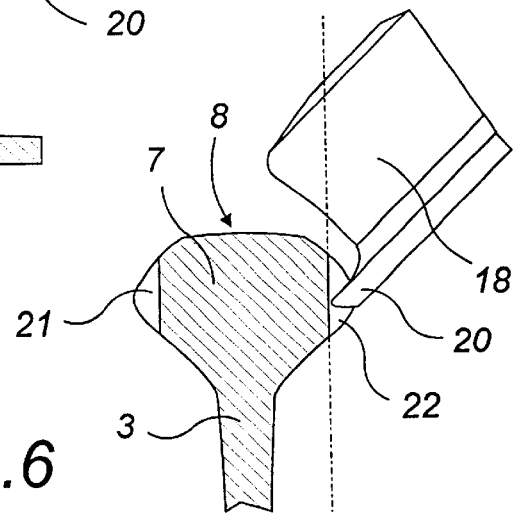
FIG.6

GUIDE RAIL WITH ENGAGING-RELEASING SLOTS FOR A ROLLER GUIDE ASSEMBLY IN PARTICULAR WITH INCLINED ROLLERS

The guide rails for the rollers or guide wheels of road vehicles assume different technical forms depending upon the type, angle, and cross-section profile of the guide wheels, as well as their general configuration.

BACKGROUND OF THE INVENTION

The present invention concerns angled or even horizontal guide wheels used in pairs for travel along a rail adapted for that purpose. More specifically (but not exclusively), it applies to guide wheels angled as a downward pointing V, each wheel having a peripheral shoulder traditionally called a flange, similar to railway wheels.

For guiding movement, each guide wheel in a pair of guide wheels contact the sides of a guide rail as they move and in certain cases, they are locked onto the sides of the rail.

There is a need for improvement in both the quality and safety of guided travel. In prior art embodiments, maintaining the guide wheels tightly in contact with the sides of the guide rail assured safety and quality. Often a vertical precharge was also used to prevent the wheels from occasionally lifting unexpectedly during operation.

According to these prior art embodiments, the guide wheels were extracted by separating them, either by making use of the flexible force pressing the wheels together, or unlocking them and temporarily separating them while pulling them up. This operation required a means for separating the guide wheels enough to disengage them from the rail, or requires the guide wheels to be shaped and constructed so that a single vertical force could be used to extract them.

The quality and safety of guided movement can be improved remarkably by using guide wheels with a peripheral projection or a portion of the body which moves along below the linear rim of the rail head. This is the case with flanged guide wheels which operate at an angle, with the flange positioned below the rim. Another example might be simple guide wheels that move beneath the rail head, for example, along the rail web.

While these guide wheels provide secure guided travel, the projections protruding from the rail, that is, the sides of the rail head, form an obstacle when raising the guide wheels. In order to raise the wheels, there must be some means for either changing their angle, separating them, or accomplishing both of these movements either simultaneously or successively.

Incorporating these functions complicates the design of the guide wheels, requiring additional functions to take place in small, awkward spaces.

Public transportation and companies dependent upon guided travel impose many demands that must be fulfilled simultaneously, while at the same time attempting to simplify operation and design and improve safety and reliability:

First and foremost are acquisition and operation costs, which are important purchase conditions;

Second, the guaranteed reliability and safety of guide wheels which cannot physically slip out of the rail during operation; and Finally, simplified operation, with a quick, simple method of disengaging the wheels from the rail and subsequently raising the guide assembly.

SUMMARY OF THE INVENTION

The goal of the present invention is to propose a satisfactory solution which allows the guide wheels to freely engage and disengage from the rail, either when stopped or when moving, in the case of guide assemblies using a pair of guide wheels, especially (but not exclusively) flanged guide wheels angled at a V.

To achieve this, the invention relates to a guide rail for angled guide wheels used in pairs and laterally engaging the guide rail, each guide wheel having a flange to prevent derailment, characterized in that the rail has certain areas where the guide wheels can be removed from the rail when subjected to a lifting force, but the guide wheels remain in contact with these areas as they are displaced during normal travel.

The multiple advantages of the invention concern the simplified design of the guide assembly, the guide wheel engagement-disengagement action, and reliable performance during guided travel.

First, the guide assembly is simplified due to the elimination of any device for separating the guide wheels.

Second, engaging and disengaging the guide wheels from the rail is accomplished by exerting only a simple vertical force which raises or lowers them in specific limited areas equipped with small slots, said areas either having visual markers or some other type of marker.

In addition, flanged wheels with a limited number of working parts are used to assure satisfactory performance.

Furthermore, it is no longer necessary to provide specific areas equipped to engage/disengage the guide wheels, since this can be accomplished by merely inserting a rail or a rail portion with slots at any given location for use when changing the guide mode.

Finally, the slots are simple to form and do not interfere with guide wheel movement, since they are shallow and limited in length; for this reason, they only reduce the width of the guide wheel path very slightly.

BRIEF DESCRIPTION OF THE DRAWINGS

Other characteristics and features of the invention will be apparent from the description, which is provided as a non-limiting example, and with reference to the accompanying drawings, wherein:

FIG. 4 is a frontal view of the slotted rail with two oblique guide wheels contacting the guide rail as they pass along it;

FIG. 5 is a combined frontal view and cross-section analogous to FIG. 4 illustrating upward disengagement of the guide wheels;

FIG. 6 is an enlarged detailed view in transverse cross-section of the area with the slots showing the empty space for passage of the flange;

DESCRIPTION OF THE PREFERRED EMBODIMENTS

Figure 1:
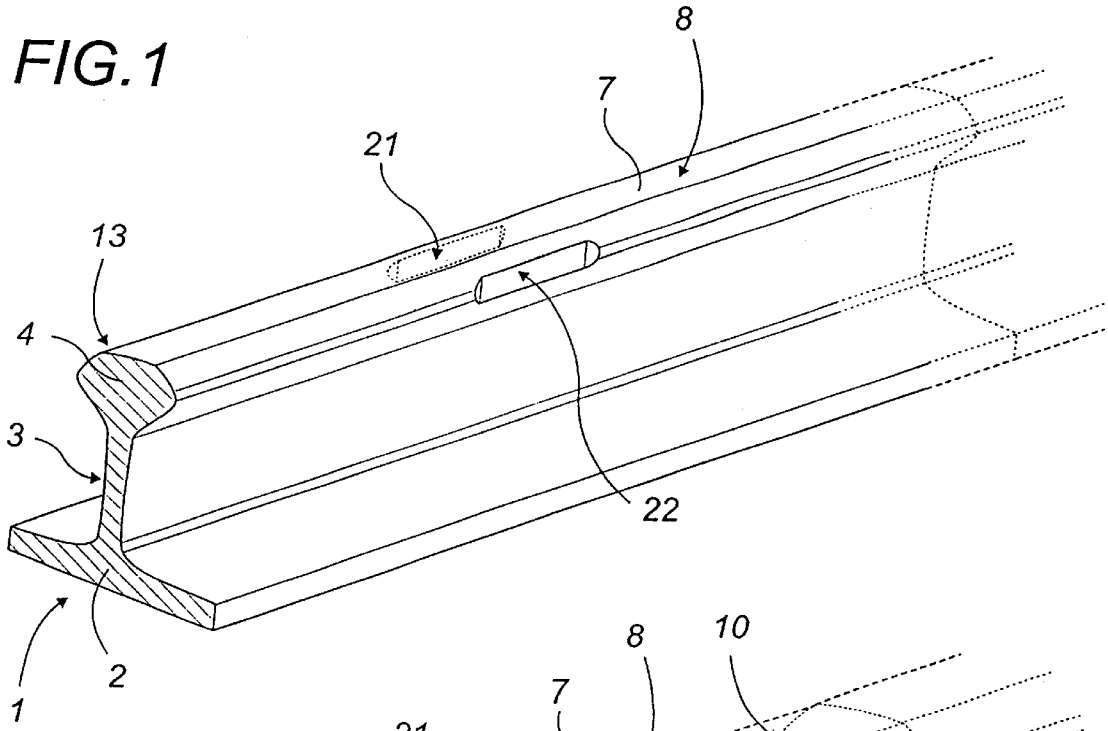
FIG. 1 is a perspective of a guide rail portion with two opposite slots.
Figure 2:
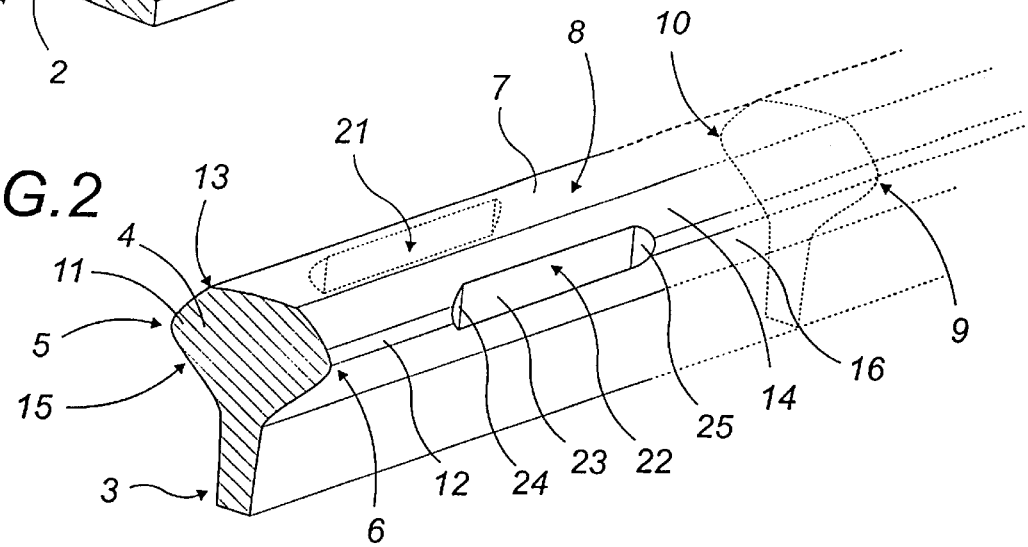
FIG. 2 is a perspective of the rail of FIG. 1 enlarged in the area of the slots.
Figure 3:
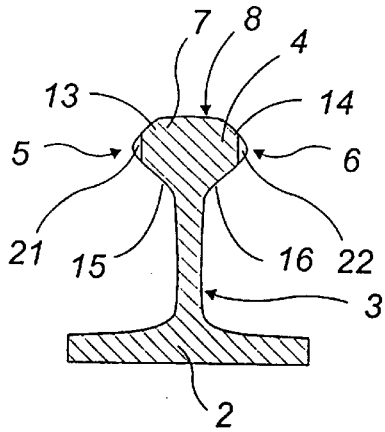
FIG. 3 is a transverse cross-section showing the area of the slots in the guide rail shown above.
Figure 7:
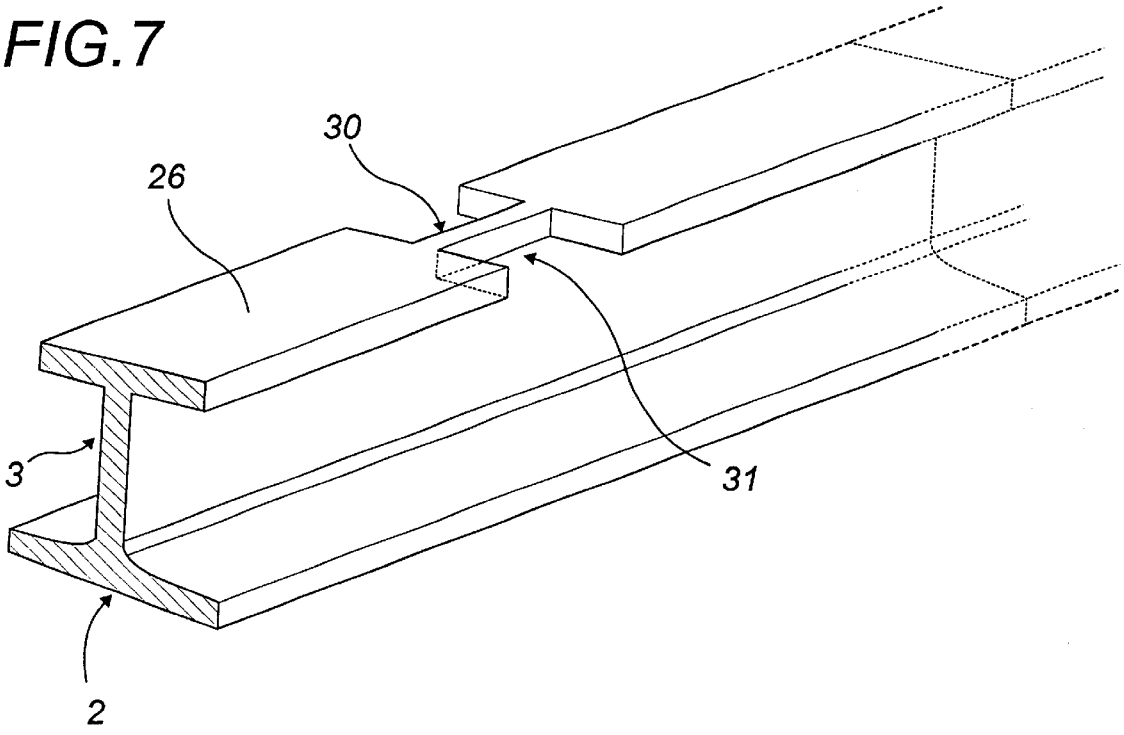
Figure 8:
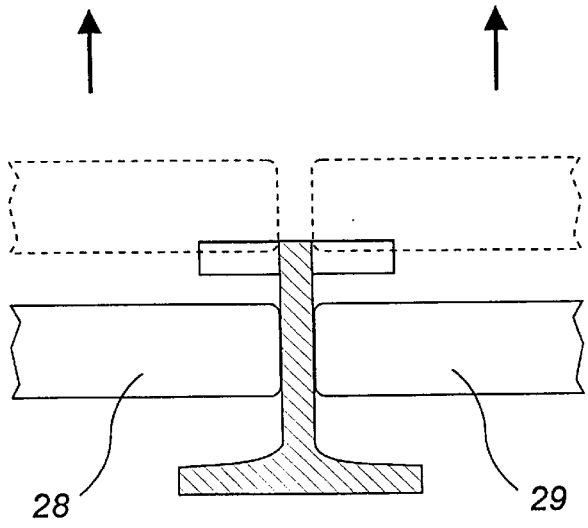
FIG. 8 is a transverse cross-section of the guide rail of FIG. 7 at a slot showing the guide wheels in contact with the rail web during motion.

The guide rail of the invention can assume different technical forms. The general inventive concepts consists in providing in localized areas on the rail and in its upper structure or rail head, at least one recessed area transverse to the rail and open to the exterior, through which one of the guide wheels passes when the arm supporting the wheels is raised, thereby avoiding any separation between the wheels or change in the wheel angle. The length of the slots varies depending upon whether the engagement or disengagement functions take place during operation or when the vehicle is stopped.

The guide rail of the invention has a body 1 with various technical forms. It invariably includes the elements of a modern rail such as a rail cushion (base) 2 with a lower foundation. The cushion extends into rail web 3 terminating in rail head 4.

Rail cushion 2 and web 3 are generally conventional in shape.

Conversely, the shapes of the rail heads in the first variation (FIGS. 1 through 6) are considered totally novel.

The rail head elements consist of two symmetrical, rounded, convex sides 5 and 6 linearly connected at the upper portion by a linear connection zone 7 which is either flat or slightly convex, forming the central portion of motion surface 8.

Within the space, the rounded portion of each side consists of two successive inclined surfaces sloping in opposite directions and separated by a rounded, convex central projection 9 or 10. Preferably, these inclined surfaces and the central projection curve inward and are connected to each other and to the nearby areas by rounded elements 11 or 12 extending through the space in a linear direction.

As for the upper portion of each side, it forms an upper ramp 13 or 14 for movement, each one serving as a track for one of the guide wheels. Each of the sides extends downward into curved central projection 9 or 10 followed by a lower oblique stop 15 or 16 angled in the opposite direction of upper ramp 13 or 14, and forming a lateral projection on either side. Each lower stop comprises at its extremity a connection zone constituting the junction with the web 3 of the rail. Each track, either upper ramp 13 or 14, slants down toward the outside of the rail, while each inclined lower stop 15 or 16 slants up toward the outside of the rail.

While not highly specialized, this rail is configured specifically for guided travel using a pair of guide wheels 17 and 18 that are either horizontal or angled in a downward-pointing V, with flanges 19 and 20, that is, guide wheels with a peripheral shoulder on their broad exterior surface constituting a stop that contacts the sides of rail head 4 to limit lateral displacement. This design not only prevents the guide wheels from slipping either transversely or vertically, but also prevents the guide assembly from lifting unexpectedly.

Flanges 19 and 20 can each contact the subsurface of the rail during movement, that is, against lower inclined surface 15 or 16.

According to the preferred embodiment shown in the drawings, the shape of the rounded end of each side is complementary to the profile of the transition between the tread of each guide wheel and the flange.

Guide wheels 17 and 18 are supported by a guide assembly (not shown) with a mechanical support formed as a lifting pivot arm.

The essential feature of the invention concerns the existence of localized engagement-disengagement zones, each consisting of a least one recessed area in each side of rail head 4.

More specifically, at least one but preferably two opposing slots 21 and 22 are each formed by a recessed area or a lateral linear groove, with a base 23 which is flat but is not necessarily flat formed transversely within at least one of the rounded sides of rail head 4, extending to a limited depth that is sufficient for the passage of the lower portion of the flange 19 or 20 opposite the slot, or the flanges on both opposite guide wheels without modifying the design, or more specifically, the angle or the separation between the guide wheels as they are being raised.

The slots are deep enough to allow enough space at the upper portion of the rail head for the guide wheels to roll smoothly. Thus, the depth of the slots does not significantly reduce the width of the guide wheel path.

Slot base 23 may be flat or concavely curved forming an opening adapted in shape to accommodate the vertical passage of the portion of the flange which is vertically and transversely displaced inside the slot.

The recess forming the slot shown with a flat base has two longitudinal extremities, each defined by an inlet ramp 24 and 25 with progressively sloping surfaces or concave rounded surfaces for connection to the sides of the rail.

The base length of each slot depends upon its intended use. If the engagement-disengagement operation takes place during a stop, the slot length will be limited to the smallest possible size, i.e., it will preferably be slightly larger than required for passage of the flange without changing the angle of the guide wheels to raise them.

If the engagement-disengagement operation takes place during operation, preferably at low speed, the slots will be longer in proportion to the linear trajectory traveled during the time it takes the guide assembly to lift or descend. The space for raising and lowering the guide arms is limited as much as possible, It is also possible to provide slots of reduced length for the engagement-disengagement maneuvers if the raising or lowering actions have already taken place prior to reaching the slotted area.

According to the invention, the slots decrease the width of the rail enough to allow the guide arm to be raised or lowered without requiring any modification in the relative angle of the guide wheels and without requiring them to be disconnected from each other. The narrowed rail in these areas makes it easier to extract or engage the guide wheels in each case with a simple vertical movement.

The limit of the trajectory while the extremity of the guide wheels is being raised is shown in FIG. 6 by a broken vertical line.

In this variation providing for engagement-disengagement during operation, it is important for the angled surfaces leading out of the angled slot surfaces to be designed to serve as pathways for the guide wheels as they leave the slot. The same is true for the angled surfaces leading into the slot. Of course, the shape of the slot base must be adapted to the engagement-disengagement movement when it takes place during operation.

Until now the description has primarily involved two opposing slots. It is important to note that the invention also concerns variations with a single slot.

The rail may have different profiles. These different shapes consist of known shapes as well as novel shapes.

By way of example, FIGS. 7 through 12 show a guide rail with an "I" shaped profile and a flat rail head 26 having a flat track, and then another profile of the same general shape but varying slightly, with a trapezoidal rail web 27.

When the rail has this type of profile, simple guide wheels 28 and 29 roll along the sides of rail web 3 or 27. Restraining them tightly against each other is conducive to precisely guided movement.

With the I-shaped profile, the wheels are positioned horizontally, and in the case of a trapezoidal rail web 27, they are angled.

In these two embodiments, there are slots formed by transverse recessed areas 30 and 31 disposed opposite the upper portion of flat table 26 forming the rail head. Unlike the preceding embodiments, the slot depth may and must, in the first case, extend as far as the junction with the extension of the upper web portion; and in the second case, as far as the vertical projection toward the top of the innermost rim of each guide wheel in its moving position. In this way the remaining portion 32 of the rail head between slots 30 and 31 is defined.

Figure 9:
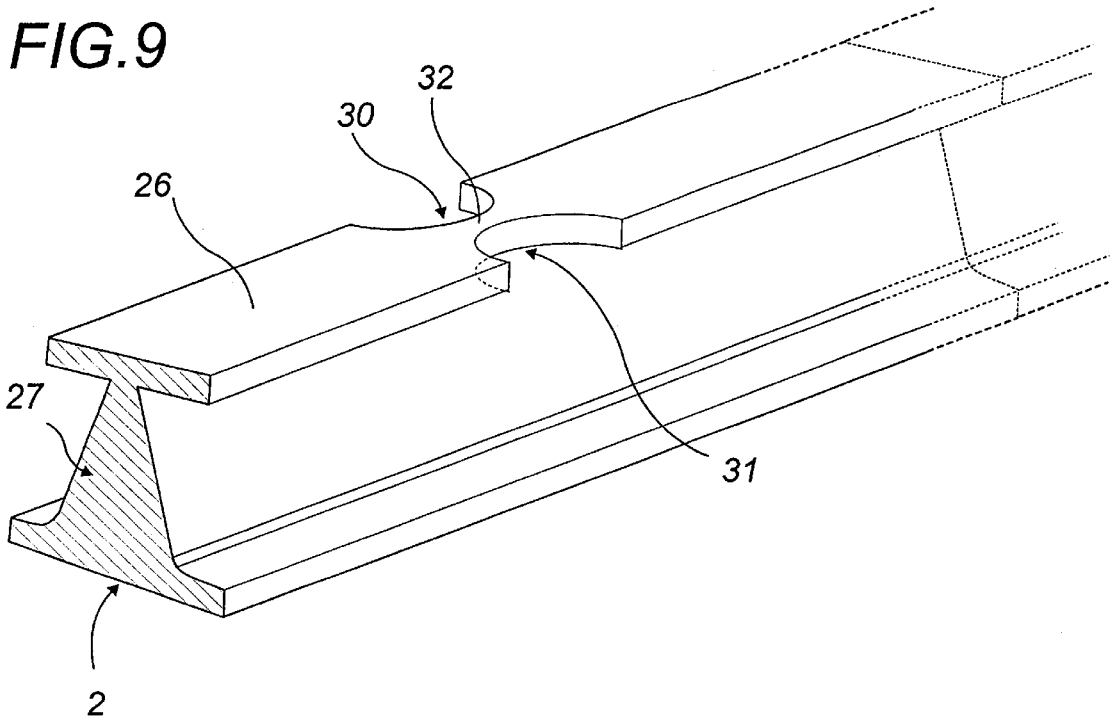
FIGS. 9 and 10 are analogous views to FIGS. 7 and 8, respectively, in the case of a guide rail with a trapezoidal web and a flat upper portion.
Figure 10:
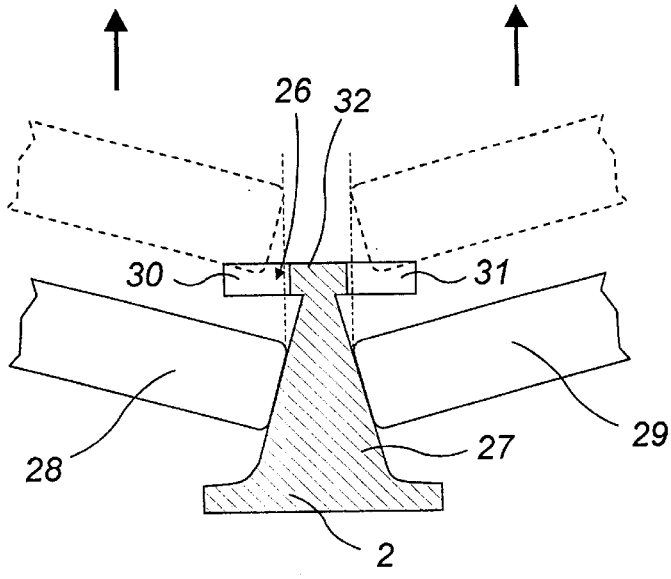

Here, as well, the inclined inlet and outlet surfaces as well as the slot bases may be curved inward, for example, forming concave rounded areas as shown in FIG. 9.

Figure 11:
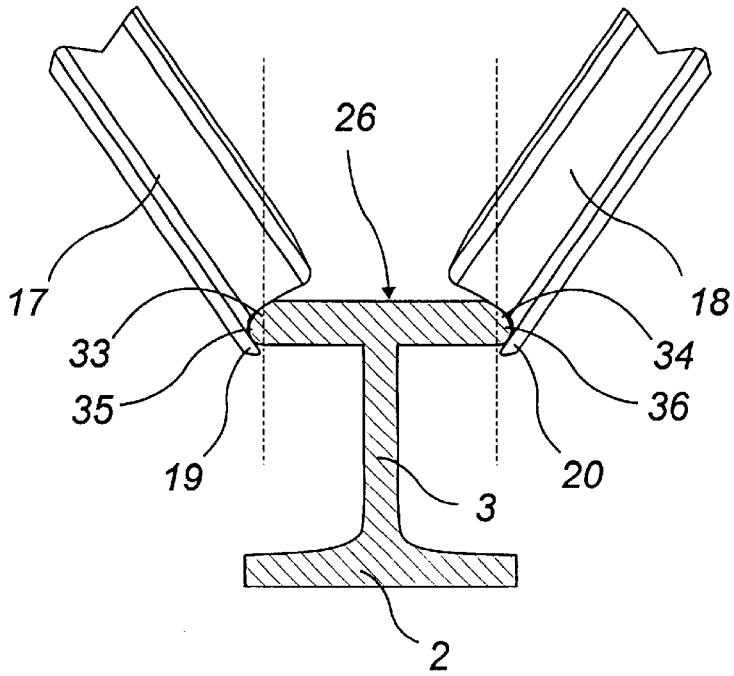
FIG. 11 is a transverse cross-section of a variation with a flat rail head and flanged guide wheels.
Figure 12:
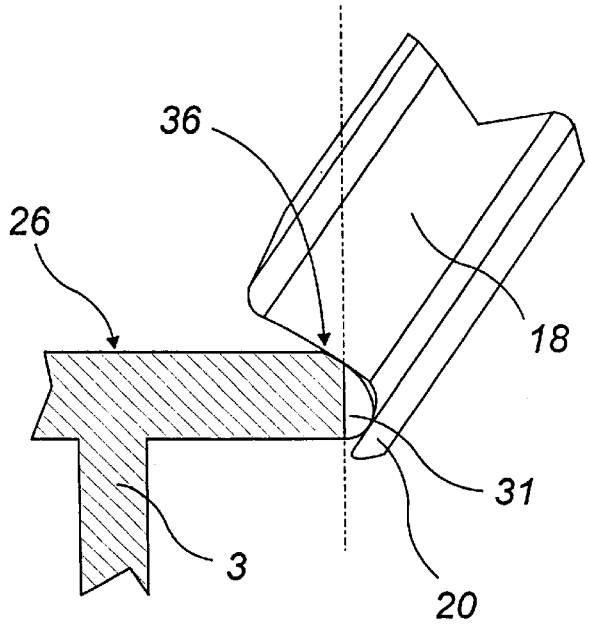
FIG. 12 is an enlarged transverse cross-section in the area of a slot in the variation shown in FIG. 11.

Another variation with a flat rail head is shown in its entirety in FIG. 11 and an enlarged portion is shown in FIG. 12. This variation is used with guide wheels 17 and 18 equipped with flanges 19 and 20 similar to those described previously.

Each guide wheel rolls along the upper ridged zone 33 or 34 of adjacent lateral edge 35 or 36 of flat rail head 26, which in this variation takes the form of a flat table. The guide wheels are angled so that the flange 19 or 20 on each one is placed below the corresponding lower ridge of adjacent lateral edge 35 or 36, causing the same difficulty during lifting which the invention has resolved.

As before, it is possible to lift the guide wheels and avoid separating them or changing their angle because of the provision of slots 30 or 31 described above.

The drawing shows the relative depth of the slots and the dotted line shows the limit of the trajectory of the lower extremity of the flange during the lifting procedure.

In this variation, the guide wheels no longer roll along the sides of the rail web, but along the upper rim of edges 35 and 36 of the edges of flat table 26, which are rounded for this purpose.

Many other technical forms are possible. They cannot all be represented. They all fall within the scope of the invention to the extent they incorporate engagement-disengagement slots.

What is claimed is:

1. A guide rail for guiding a pair of angled or horizontal guide wheels (17,18) of a guide assembly, the guide rail comprising:

a rail base (2) for engagement with a support surface, a rail head (4);

a rail web (3) interconnecting the rail base (2) with the rail head (4), and at least one of the rail head (4) with a rail web (3) forming a guiding pathway (13,14) for guiding the guide wheels of the guide assembly when engaged therewith;

wherein the rail head (4) has at least one zone which facilitates at least one of engagement of the guide wheels with the guide rail and disengagement of the guide wheels from the guide rail, the at least one zone has a narrowed area in which the guide head (4) has a narrower transverse width dimension which is less than a larger transverse width dimension of the guide head (4) on opposite sides of the at least one zone such that the pair of guide wheels (17,18) are only movable vertically into and out of engagement with the guide rail, relative to the narrower transverse width dimension, in the at least one zone while the pair of guide wheels (17,18) are prevented from moving vertically into and out of engagement with the guide rail, relative to the guide rail, by the larger transverse width dimension of the guide head (4).

2. The guide rail according to claim 1, wherein the guiding pathways (13,14) for the guide wheels (17,18) are provided even at the narrowed area.

3. The guide rail according to claim 2, wherein the guiding pathways (13,14) for the guide wheels (17,18) in the narrowed area are extensions of lateral walls of the narrowed area and an upper median zone of the rail head (4).

4. The guide rail according to claim 1, wherein the narrowed area is locally recessed toward the central portion of the rail head (4).

5. The guide rail according to claim 4, wherein the narrowed area is formed as lateral notches (21, 22).

6. The guide rail according to claim 5, wherein the recessed areas comprise a first lateral notch (21) and a second lateral notch (22), and each of the first and second lateral notches (21, 22) have a flat base (23).

7. The guide rail according to claim 6, wherein the flat base of the first lateral notch (21) and the flat base of the second lateral notch (22) extend parallel to a longitudinal direction of the rail web (3).

8. The guide rail according to claim 1, wherein the first and second notches (21, 22) are located opposite to one another on opposite sides of a central median longitudinal plane which extends through the guide rail.

9. The guide rail according to claim 1, wherein the at least one zone comprises only one narrowed area.

10. The guide rail according to claim 6, wherein the first and second notches (21, 22) are slightly longer in length than a section provided for passage of a peripheral shoulder or a flange of the guide wheels.

11. The guide rail according to claim 6, wherein the first and second notches (21, 22) are each long enough to allow engagement of the guide wheels with the guide rail to occur during relative axially movement of the guide wheels with respect to the guide rail and allow disengagement of the guide wheels from the guide rail to occur during relative axial movement of the guide wheels with respect to the guide rail.

12. The guide rail according to claim 1, wherein each of the first and second notches (21, 22) have longitudinal extremities formed by two inclined surfaces with transverse extremities (24 and 25) forming a transverse guiding pathway for the guide wheels during the engagement process and the disengagement process.

13. The guide rail according to claim 12, wherein the inclined surfaces with transverse extremities (24 and 25) are inwardly curved surfaces.

14. The guide rail according to claim 13, wherein the inwardly curved surfaces are concave rounded areas.

15. The guide rail according to claim 1, wherein the rail head (4) is formed of two convex, rounded symmetrical sides (5 and 6), and upper portions of the two convex, rounded symmetrical sides (5 and 6) form the guiding pathways (13, 14) for angled guide wheels (17 and 18) and which are joined by a connection zone to form an entire upper movement table (8), each side extending downward into a curved convex central projection followed by an angled stop and a portion connecting to the web (3) of the rail.

16. The guide rail according to claim 1, wherein the rail head (4) is in a shape of a flat table.

17. The guide rail according to claim 16, wherein an upper longitudinal edge of the rail head (4) serves as the guiding pathway (13, 14) for the guide wheels (17, 18).

18. The guide rail according to claim 1, wherein the rail web (3) serves as the guiding pathway (13, 14) for the guide wheels (17, 18).

19. The guide rail according to claim 16, wherein the rail web (3) is rectangular in cross-section.

20. The guide rail according to claim 8, wherein the rail web (3) is rectangular in cross-section.

21. A guide rail for guiding a pair of angled or horizontal guide wheels (17,18) of a guide assembly, the guide rail comprising:

a rail base (2) for engagement with a support surface, a rail head (4);

a rail web (3) interconnecting the rail base (2) with the rail head (4), and at least one of the rail head (4) with a rail web (3) forming a guiding pathway (13,14) for guiding the guide wheels of the guide assembly when engaged therewith;

wherein the rail head (4) has at least one zone which facilitates at least one of engagement of the guide wheels with the guide rail and disengagement of the guide wheels from the guide rail, the at least one zone has a narrowed area in which the guide head (4) has a narrower transverse width dimension which is less than a larger transverse width dimension of the guide head (4) on opposite sides of the at least one zone and less than a normal engagement spacing of the guide wheels from one another such that the pair of guide wheels (17,18) are only movable vertically into and out of engagement with the guide rail, relative to the narrower transverse width dimension, in the at least one zone without having to alter the normal engagement spacing of the guide wheels from one another while the pair of guide wheels (17,18) are prevented from moving vertically into and out of engagement with the guide rail, relative to the guide rail, by the larger transverse width dimension of the guide head (4); and the rail web (13) is trapezoidal in cross-section.

22. A guide rail for guiding a pair of angled or horizontal guide wheels (17,18) of a guide assembly, the guide rail comprising:

a rail base (2) for engagement with a support surface, a rail head (4);

a rail web (3) interconnecting the rail base (2) with the rail head (4), and at least one of the rail head (4) with a rail web (3) forming a guiding pathway (13,14) for guiding the guide wheels of the guide assembly when engaged therewith;

wherein the rail head (4) has at least one zone which facilitates at least one of engagement of the guide wheels with the guide rail and disengagement of the guide wheels from the guide rail, the at least one zone has a narrowed area in which the guide head (4) has a narrower transverse width dimension which is less than a larger transverse width dimension of the guide head (4) on opposite sides of the at least one zone such that the pair of guide wheels (17,18) are only movable vertically into and out of engagement with the guide rail, relative to the narrower transverse width dimension, in the at least one zone while the pair of guide wheels (17,18) are prevented from moving vertically into and out of engagement with the guide rail, relative to the guide rail, by the larger transverse width dimension of the guide head (4); and the rail web (13) is trapezoidal in cross-section.

* * * * *